US006328442B1

(12) United States Patent
Brinkly

(10) Patent No.: US 6,328,442 B1
(45) Date of Patent: Dec. 11, 2001

(54) PARTICULATE FILTERING MUFFLER

(75) Inventor: Richard L. Brinkly, Vancouver, WA (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/494,748

(22) Filed: Jan. 31, 2000

(51) Int. Cl.[7] ..... B41J 2/01
(52) U.S. Cl. ..... 347/104
(58) Field of Search ..... 347/104, 37; 400/689, 400/690

(56) References Cited

U.S. PATENT DOCUMENTS

| | | | |
|---|---|---|---|
| 4,535,373 | 8/1985 | Schuh | 360/97 |
| 4,886,415 | 12/1989 | Engelberger et al. | 415/119 |
| 4,922,406 | 5/1990 | Schuh | 360/97.03 |
| 5,589,866 | 12/1996 | Russell et al. | 347/102 |
| 5,678,988 | 10/1997 | Amrhein et al. | 431/328 |
| 5,742,303 | 4/1998 | Taylor et al. | 347/36 |
| 5,774,141 | 6/1998 | Cooper et al. | 347/34 |
| 5,912,368 | 6/1999 | Satarino et al. | 55/320 |
| 6,116,719 | 9/2000 | Maza | 347/22 |
| 6,152,560 * | 11/2000 | Hollands | 347/93 |
| 6,155,679 | 12/2000 | Sato | 347/92 |
| 6,224,203 * | 5/2001 | Wotton et al. | 347/101 |

FOREIGN PATENT DOCUMENTS

| | | |
|---|---|---|
| 0250805 | 1/1988 | (EP) . |
| 0277615 | 8/1988 | (EP) . |
| 0741039 * | 11/1996 | (EP) . |
| 1336453 | 11/1973 | (GB) . |
| 2104148 | 3/1983 | (GB) . |
| 2236964 | 4/1991 | (GB) . |
| 8174796 | 7/1996 | (JP) . |
| WO93/03868 | 3/1993 | (WO) . |

OTHER PUBLICATIONS

United Kingdom Patent Office Search Report, Jun. 15, 2001.

* cited by examiner

*Primary Examiner*—John Barlow
*Assistant Examiner*—Ly T Tran
(74) *Attorney, Agent, or Firm*—Manuel Quiogue

(57) ABSTRACT

An ink jet printing system having a vacuum hold down, a vacuum source, and a particulate filtering muffler for trapping ink aerosol particles and muffling noise produced by the vacuum source.

2 Claims, 3 Drawing Sheets

PARTICULATE FILTERING MUFFLER

BACKGROUND OF THE INVENTION

The disclosed invention relates generally to ink jet printing mechanisms, and more particularly to a particulate filtering, vacuum noise muffling system for an ink jet printer.

An ink jet printer forms a printed image by printing a pattern of individual dots at particular locations of an array defined for the printing medium. The locations are conveniently visualized as being small dots in a rectilinear array. The locations are sometimes called "dot locations," "dot positions," or "pixels". Thus, the printing operation can be viewed as the filling of a pattern of dot locations with dots of ink.

Ink jet printers print dots by ejecting very small drops of ink onto the print medium, and typically include a movable carriage that supports one or more printheads each having ink ejecting nozzles. The carriage traverses over the surface of the print medium, and the nozzles are controlled to eject drops of ink at appropriate times pursuant to command of a microcomputer or other controller, wherein the timing of the application of the ink drops is intended to correspond to the pattern of pixels of the image being printed.

In order to provide edge to edge or "full-bleed" printing, media vacuum hold down systems are employed to hold print media to a media transport mechanism or a platen, since conventional pinch rollers can smudge wet ink.

Considerations with the use of a vacuum hold down system include noise produced by the vacuum source and the dispersion of ink aerosol that is suctioned by the vacuum source from the print zone.

There is accordingly a need for a quiet vacuum hold down system that reduces dispersion of ink aerosol.

SUMMARY OF THE INVENTION

The disclosed invention is directed to a particulate and filtering muffler for a vacuum source of an ink jet printing system having a vacuum hold down sub-system.

BRIEF DESCRIPTION OF THE DRAWINGS

The advantages and features of the disclosed invention will readily be appreciated by persons skilled in the art from the following detailed description when read in conjunction with the drawing wherein.

DETAILED DESCRIPTION OF THE DISCLOSURE

Figure 1:
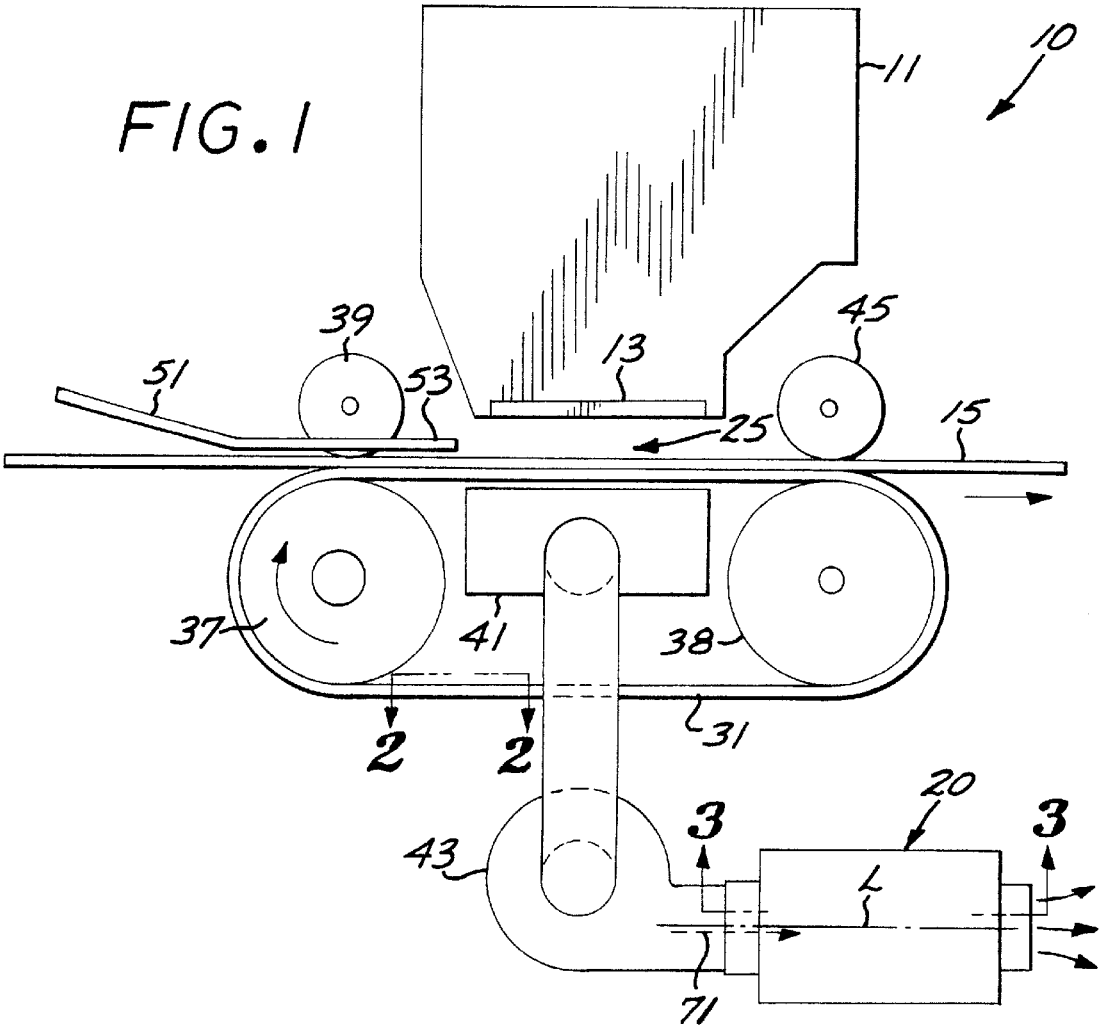
FIG. 1 is a schematic illustration of an ink jet printing system that incorporates a particulate filtering noise muffler of the invention.

In the following detailed description and in the several figures of the drawing, like elements are identified with like reference numerals.

FIG. 1 is a schematic depiction of an examplary ink jet printing device 10 in which the disclosed invention can be employed. The ink jet printing device includes an ink jet printhead 13 having a plurality of ink jet nozzles for applying marks on print media 15 that is tightly held on a media supporting belt 31 by vacuum, and in accordance with the invention includes a particulate filtering noise muffler 20 for filtering ink aerosol particles suctioned by a vacuum source 43 and muffling noise generated by the vacuum source.

Figure 2:
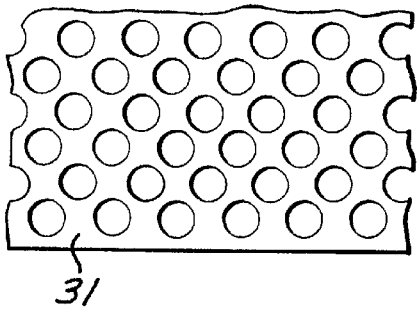
FIG. 2 is a plan view illustrating a portion of the media supporting endless belt of the ink jet printing system of FIG. 1.

The ink jet printing device 10 of FIG. 1 more particularly includes an ink jet writing instrument 11 (e.g., a print cartridge) that includes a printhead 13 having drop generators including nozzles for ejecting ink droplets onto a print medium 15 (e.g., a sheet of paper) in a print zone 25 of the printing device. The print medium 15 is supported and advanced through the print zone 25 by an endless belt media transport subsystem that includes an endless perforated 31 (also shown in FIG. 2) mounted for rotation on belt pulleys 37, 38 that are driven to advance the print medium 15.

The print medium 15 is picked from an input supply (not shown) and its leading edge is delivered to a guide 51, 53 that is configured to deliver the leading edge of the print medium 15 to the endless belt 31. An optional pinch roller 39 may be used to assist transport of the print medium 15 through the print zone. A vacuum plenum 41 that is coupled to a vacuum inducing pump 43 holds the print medium 15 tightly against the belt surface at the print zone. An output roller 45 may be optionally used to receive the leading edge of the print medium 15 and continue the transport of the print medium until the trailing edge of the print medium is released.

Figure 3:
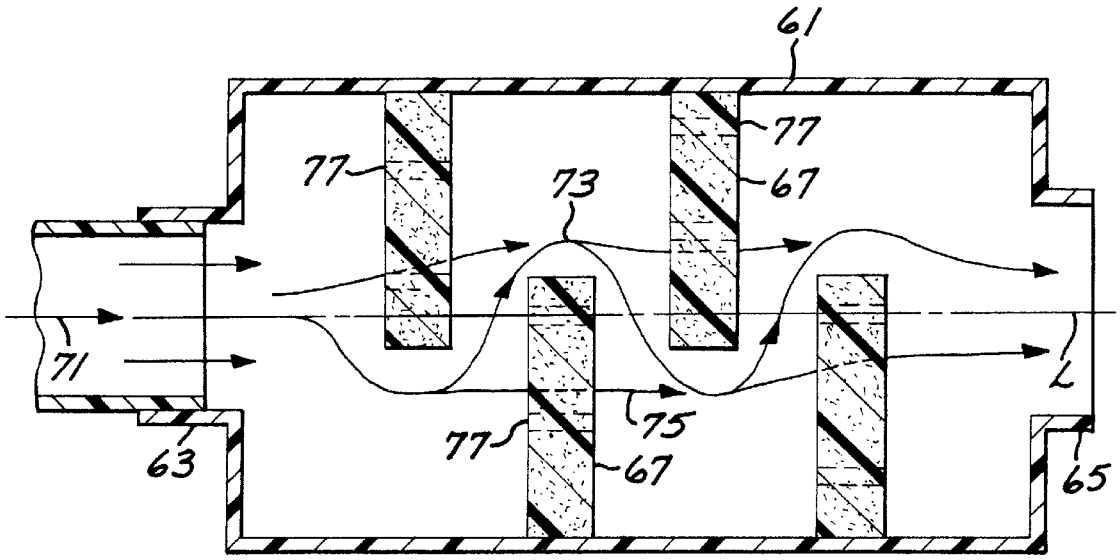
FIG. 3 is a schematic cross-sectional view of an implementation of a particulate filtering noise muffler in accordance with the invention.

Referring now to FIG. 3, schematically depicted therein is an ink particle filtering noise muffler 20 in accordance with the invention that is coupled to an exhaust port of the vacuum pump 43. The muffler 20 generally includes enclosure walls 61 that form a duct and are substantially air tight. An input port 63 is disposed at one end of the muffler 20 and receives the exhaust 71 of the vacuum pump 43, while an output port 65 is disposed at the other end of the muffler 20. Filter baffle walls 67, which can be flat, are disposed in the interior of the muffler, and in accordance with the invention are formed of a filter material that allows for partial air passage through the filter baffle walls and is of such density so as to encourage some air flow over the faces of the filter baffle walls. In this manner some of the air passing through the muffler 20 travels around at least one of the filter baffle walls, as indicated by flow arrows 73, which reduces noise along the flow path, while some of the air passing through the muffler 20 travels through at least one of the filter baffle walls 67, as indicated by flow arrows 75, which captures ink particles in the filter baffle walls 67.

The filter baffle walls 67 are formed of a micron level filtering material, for example one having an efficiency in the range of about 70% to about 95% or greater of removing 1.0 micron sized and larger particles. The filtering material can comprise polypropylene, cotton, polyester, PTFE, cellulose, paper, open cell foam, or sintered materials of plastic or metals. Depending upon the filtering material utilized, the filter baffle walls 67 can include support scrims, for example to support fiber based filtering material.

The dimensions of the muffler and the number of filter baffle walls 67 are selected depending on factors including noise reduction requirements, particulate filtering requirements, and back pressure requirements. Filtering characteristics can be varied by changes to the filter baffle wall thickness, surface porosity and lateral extent or width of the filter baffle walls 67 relative to the overall width of the interior of the muffler. Noise reduction characteristics can be changed and tuned for specific frequencies by changing the number of filter baffle walls 67. Also, the separation between an edge or tip of a baffle wall and the opposite enclosure wall 61 will affect specific frequencies.

Apertures 77 can be formed in one or more of the filter baffle walls 67 to provide for increased air flow through the muffler. For example, each of the apertures 77 can have an equivalent hydraulic diameter that is less than about 10% of the equivalent hydraulic diameter of the input port 63. Preferably, the apertures are arranged such that there is no straight through flow path through the muffler.

Figure 4:
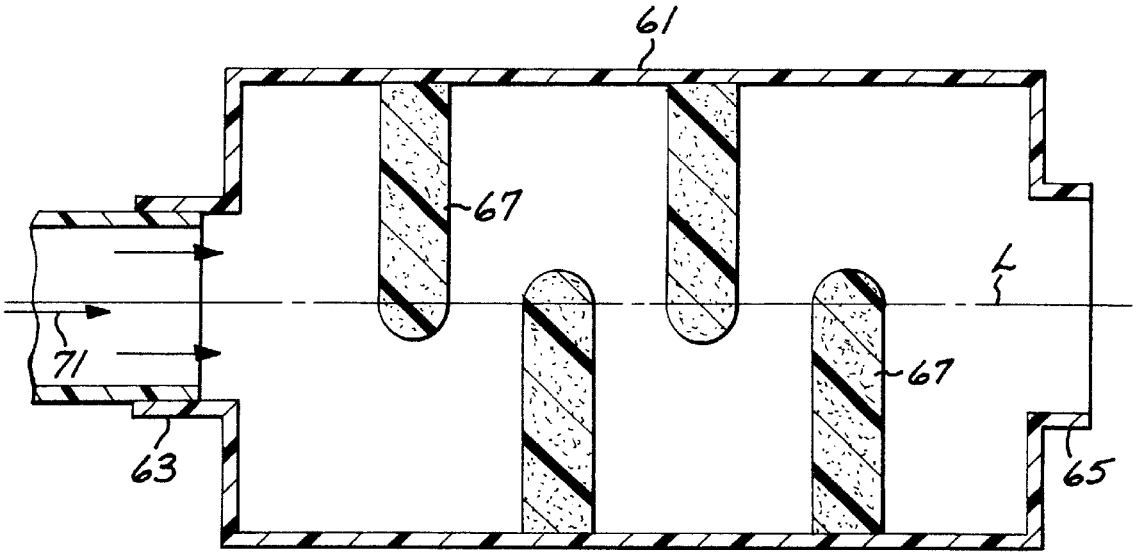
FIG. 4 is a schematic cross-sectional view illustrating a particular embodiment of the filter baffle walls of a particulate filtering noise muffler of the invention.

Also, the corners of the filter baffle walls 67 can be rounded as depicted in FIG. 4 to provide for smoother air flow around the bends in the path around the filter baffle walls 67, which may provide for better particle filtering by reducing turbulence around the bends which in turn may allow particles to follow a more direct path into the filter baffle walls 67 as a result of the momentum of the particles.

Figure 5:
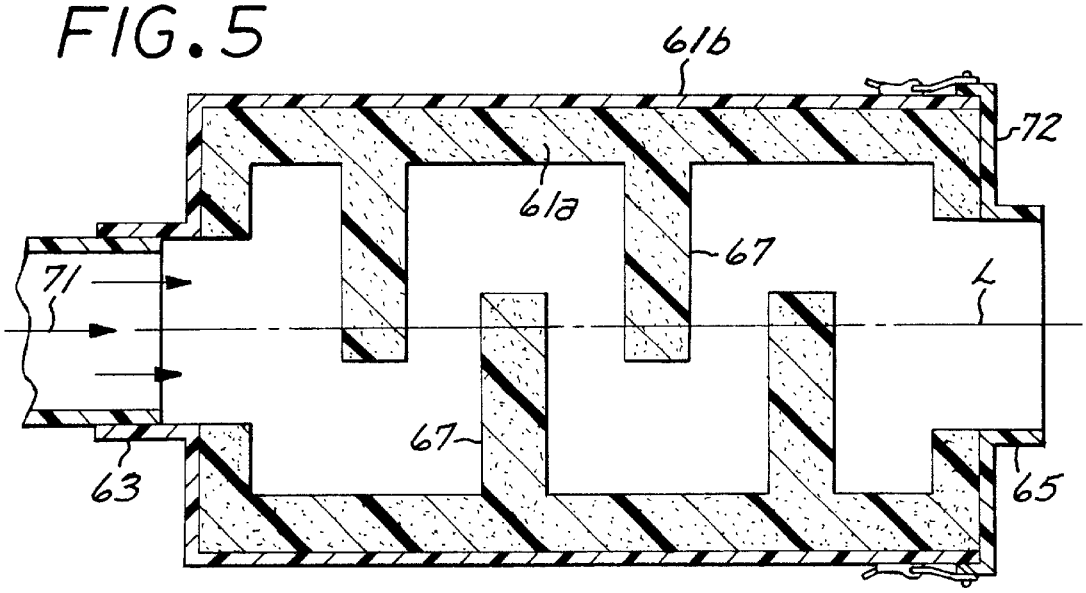
FIG. 5 is a schematic cross-sectional view of a further implementation of a particulate filtering noise muffler of the invention.

Referring now to FIG. 5, schematically depicted therein is an implementation of an ink particle filtering noise muffler 20 that includes enclosure walls 61 that are comprised of inner walls 61*a* that are formed of the same material as used for the filter baffle walls 67, and outer walls 61*b* that are substantially resistant to air flow there through. By way of illustrative example, the inner walls 61*a* and the filter baffle walls 67 comprise open cell foam that is die cut and glued together to form a muffler sub-structure that is enclosed by the outer walls 61*b*. The outer walls 61*b* and the filter sub-structure comprised of the inner walls 61 and the filter baffle walls 67 can be advantageously implemented as a filter muffler cartridge assembly wherein the filter sub-structure is a replaceable filter muffler cartridge and the muffler 20 includes a removable end cap 72. With such implementation, the filter muffler cartridge is readily replaced, for example at suitable intervals.

Figure 6:
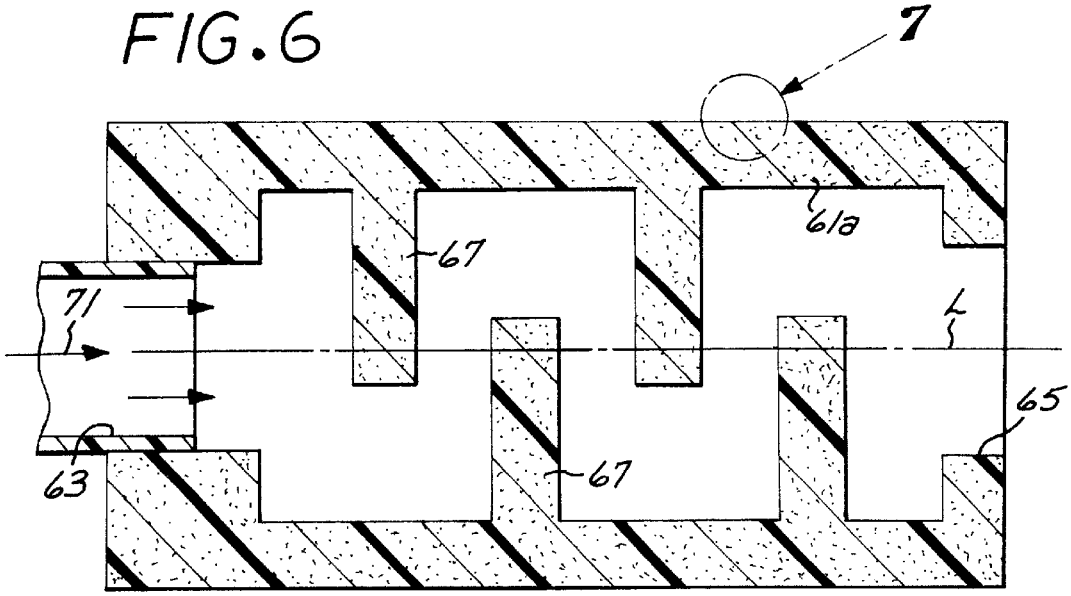
FIG. 6 is a schematic cross-sectional view of another implementation of a particulate filtering noise muffler of the invention.
Figure 7:
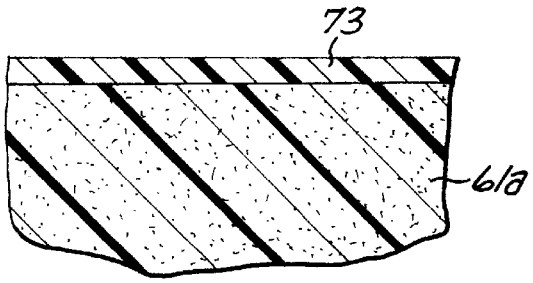
FIG. 7 is a schematic detail cross-sectional view of an enclosure wall of the particulate filtering noise muffler of FIG. 6.

Referring now to FIGS. 6 and 7, schematically depicted therein is an implementation of a particle filtering noise muffler that is similar to the muffler of FIG. 5 with the addition of a sealant coating 73 disposed on the outside surfaces of the inner walls 61*a* to prevent air flow through the inner walls 61, in which case the outer walls 61*b* can be omitted since the coating performs the function of preventing air flow through the enclosure walls of the filter muffler. By way of illustrative example, the sealant coating comprises a vinyl polymer.

The particle filtering noise mufflers of FIGS. 5 and 6 provide for greater noise suppression since the inner walls 61*a* are of the same material as the filter baffle walls 67. The cross sectional thickness of the inner walls 61*a* can be adjusted to tune for specific frequency attenuation.

The foregoing has thus been a disclosure of a particulate filtering muffler for an ink jet printing system that advantageously traps ink aerosol and muffles the noise of a vacuum source.

Although the foregoing has been a description and illustration of specific embodiments of the invention, various modifications and changes thereto can be made by persons skilled in the art without departing from the scope and spirit of the invention as defined by the following claims.

What is claimed is:

1. A noise muffling and particulate filtering system comprising:

a duct having an interior;

particle entrapping filter baffle walls disposed in the interior of said duct for trapping ink aerosol particles;

wherein said duct and said filter baffle walls are formed of the same material; and a sealant coating disposed on the outside of said duct.

2. An ink jet printing system comprising:

a vacuum hold down mechanism for holding a print medium;

an ink jet writing instrument for making marks on the print medium;

a vacuum pump for providing a vacuum to the vacuum hold down mechanism;

a duct for receiving exhaust from said vacuum pump;

particle entrapping filter baffle walls disposed in the interior of said duct for trapping ink aerosol particles;

wherein said duct and said filter baffle walls are formed of the same material; and a sealant coating disposed on the outside of said duct.

* * * * *